United States Patent [19]

Reed et al.

[11] 4,094,632

[45] June 13, 1978

[54] ACCELERATED RESPONSE FOR DELIVERY OF SMOKE SUPPRESSANT TO FLARES

[75] Inventors: Robert D. Reed; Vern A. Street, both of Tulsa, Okla.

[73] Assignee: John Zink Company, Tulsa, Okla.

[21] Appl. No.: 766,133

[22] Filed: Feb. 7, 1977

[51] Int. Cl.[2] ..... F23D 13/20

[52] U.S. Cl. ..... 431/202; 23/277 C; 431/4; 431/190; 431/5

[58] Field of Search ..... 431/202, 4, 5, 79, 190; 23/277 C

[56] References Cited

U.S. PATENT DOCUMENTS

| | | | |
|---|---|---|---|
| 2,761,496 | 9/1956 | Verner et al. | 431/202 |
| 2,779,399 | 1/1957 | Zink et al. | 431/202 X |
| 2,891,607 | 6/1959 | Webster et al. | 431/202 X |
| 3,771,940 | 11/1973 | Stranahan et al. | 431/202 X |
| 3,973,899 | 8/1976 | Reed et al. | 431/202 |

*Primary Examiner*—Edward G. Favors

*Attorney, Agent, or Firm*—Head, Johnson & Chafin

[57] ABSTRACT

An improved apparatus for very rapidly providing a supply of smoke suppressant to a flare stack, upon the incidence of flow, up to 10% of maximum rate of flow, of waste gases, which is provided in addition to the conventional apparatus for controlling the flow of smoke suppressant, such as steam, to the flare stack, upon the initiation of large volumes of waste gas flowing to the flare stack. This improved apparatus comprises a flow detector in the conduit carrying the waste gases to the flare stack, which is sensitive to flows up to 10% of maximum. The outputs of the flow detector, in the form of high and low pressure tubes, are connected to a pressure differential switch, which connects power to an appropriate solenoid valve, which controls a limited flow of smoke suppressant, such as steam, to the flare stack. Each of the parts namely the flow detector, pressure switch, and solenoid valve are very rapid-acting, so that as soon as the flow of waste gases reaches a selected level, the flow of suppressant is started, and combustion at the top of the flare stack will be smokeless from the first flow of gas.

8 Claims, 5 Drawing Figures

ACCELERATED RESPONSE FOR DELIVERY OF SMOKE SUPPRESSANT TO FLARES

BACKGROUND OF THE INVENTION

1. Field of the Invention

This invention lies in the field of smokeless combustion of waste gases in flare stacks.

More particularly it concerns apparatus for the rapid control of the flow of smoke suppressant to the stack upon the initiation of a rapid flow of waste gas to the stack.

2. Description of the Prior Art

In the prior art of flare burning of emergency released combustible gases to flares, it is a common procedure to supply and inject steam to the flare flame, for suppression of smoke.

It will be obvious from the study of the prior art, that both flared gases and steam, as a suppressant, must be delivered to the flare simultaneously, for gas burning and steam delivery to chemically accomplish the suppression of smoke, in the combustion of the gases. In order to accomplish the simultaneous gas and steam delivery to the flare on a controlled basis, there have been systems devised wherein detector means of various sorts, initiate a pneumatic control fluid to a controlled valve, so that the valve can be opened to initiate flow of steam, etc.

These systems have been widely used but have exhibited the undersirable characteristic of delayed steam delivery, and consequent considerable smoke production, when sudden bursts of gas flow, equal to a substantial portion of flare ultimate capacity, arrive at the flare discharge point. This sudden flow of gas is ignited and burned before steam, as a smoke suppressant, can be delivered to the flare. The delay in steam delivery is due to either the basic principle of operation, or to the slow response of the control system, which is characteristic of pneumatic control, generally, or to both, as the case may be. It is therefore important to find some way to quickly detect the onset of gas flow to the flare, and equally quickly to initiate the flow of steam, neither of which is provided by the prior art equipment.

SUMMARY OF THE INVENTION

It is a primary object of this invention to provide a sensor means and a steam flow control means which are very rapid-acting, so that at least a limited flow of smoke suppressant can be provided to the flare mouth substantially at the same time, that the flow of flare gas reached a substantial portion of its maximum flow.

It is a further object of this invention to provide, in addition to the conventional slow-acting flow control means for supplying suppressant to the flare stack, a fast-acting control means that will provide a selected fraction of the total flow of steam that may be required, in a very rapid-acting manner, for a selected time interval, in order to provide a rapid flow of suppressant at the initiation of gas flow, and until the conventional slow acting controls can complete the maximum flow of suppressant that may be required.

These and other objects are realized and the limitations of the prior art are overcome in this invention by providing a rapid-acting sensor of gas flow to the flare. This comprises, as an example, a doubled-ended system with an upstream orifice and a downstream orifice, in a cylindrical structure, back to back, with appropriate small diameter pressure lines, one from the upstream orifice carrying a high pressure, and the other from the downstream orifice carrying a reduced pressure. These pipes lead out of the conduit through which the gas flows to the flare stack, and go to a pressure switch, which includes a diaphragm, one side of which is connected to the high pressure tube, and the other side to the low pressure tube. Deflection of the diaphragm operates to close a switch, which operates a solenoid valve, and causes the immediate flow of steam, as a smoke suppressant, to the mouth of the flare stack.

The present invention provides apparatus for acceleration of the delivery of steam, or other smoke suppressant, to the flare, for smoke suppression, when there is a significant and sudden burst of gases for flame burning. A significant value can be considered as about 10% of the ultimate flare capacity for gaseous discharge and burning, or more. In less sudden delivery of gases to the flare for burning, the conventional controls, as above, are adequate for smoke suppression.

In one type of control system, a photoelectric scanning means is sighted onto the top of the flare stack, and provides an electrical response when the flame appears at the mouth of the stack, due to a sudden onset of gas flow.

In other systems, the flow meter, or pressure sensor or other means in the concuit carrying the flare gas, creates a signal, transmitted by pneumatic means to a controlled valve in the steam line.

This invention can be applied to any of the existing types of slow acting systems. As an auxiliary rapid-acting system, for the provision of a limited supply of steam for the short time, measured in seconds, that it takes the conventional system to fully open the steam line.

Even though the delay of a conventional system may be of the order of five to ten seconds, which is in itself a fairly short time interval, there may be such a large volume of gas suddenly released that a large volume of smoke would be produced before the steam could effectively be injected into the flame to provide smokeless combustion, and the pollution resulting would be very undesirable.

In the present system the use of a device which is capable of sensing flow-induced pressure states both upstream of and downstream of a flow obstruction for waste gases in combination with a differential-pressure switch, a rapid-acting valve for a limited quantity of steam, and including also a time delay device that will open the circuit on the quick-acting steam valve at some selected time after the main stream valve has been opened by the conventional prior art system.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
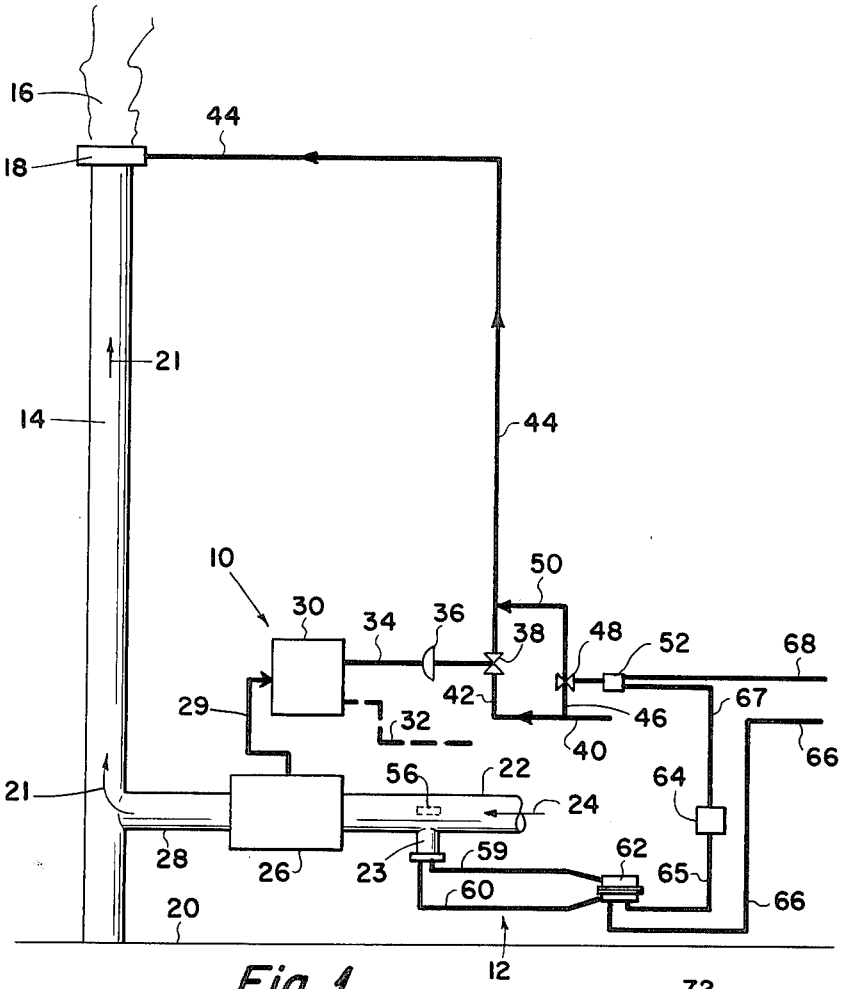
FIG. 1 illustrates one embodiment of the present invention in use as an auxilliary, rapid-acting means for providing, for a short period, a relatively small quantity of steam to the flare stack, as rapidly as possible after the initiation of the gas flow.

Referring now to the drawings and in particular to FIG. 1 there is indicated generally, by the numeral 10, a conventional type of steam control system, for the control of steam flow, as a smoke suppressant, to the top of the flare stack upon initiation of flow of waste gases to the flare stack. Indicated generally by the numeral 12, is an apparatus of this invention, which is attached to the same flow line for the waste gases, which initiates a more rapid signal, and provides a more rapid valve operation, for initiating steam flow to the flare stack.

A flare stack 14 of conventional design is provided with a steam injection apparatus 18 (as is well known in the art) at the top of the flare stack, to inject steam in a conventional manner into the flame 16. The steam is provided via line 40 whenever waste gases, indicated by the numeral 24, flow into a conduit or flow line 22, through a conventional control apparatus 26, and through a junction 28 with the flare stack 14, according to arrows 21, to the top of the stack.

The box 26, which is in series when the flow line 22 indicates any of the prior art systems, that provide a control signal, such as an electrical voltage or a pneumatic pressure, in a line 29, to a control means 30, which valves a flow of pressurized pneumatic fluid 32, to form a controlled pneumatic signal in line 34, to a control 36 for a valve 38 in the steam line. The steam line 40 is provided with adequate steam pressure, and flow capacity for all cases of gas flow to the flare stack. This steam flow goes by lines 40, 42 through the control valve 38 and out through line 44 to the steam injection means 18 at the top of the flare stack.

In the prior art the detecting means 26 may be of various types, all of which are conventionally relatively slow-acting, in providing a signal in line 29 to the pneumatic control 30. Furthermore, the pneumatic signal in line 34 operating the valve control 36 is also slow acting, requiring a considerable flow of air to create sufficient pressure to open the valve 38.

The delay between the time of initiation of a large and sudden flow of gas 24, until the steam valve 38 is open to its full value, may be in the range of 5 to 10 seconds, or more. While this is a relatively small time for many situations, in the control of steam to the flare stack when there is rapid flow of gas to the top of the stack, there can be an immense volume of smoke generated during those 5 to 10 seconds, before the steam flow can be initited and increased to such volume as to provide adequate smoke suppression.

It is important therefore to provide an auxiliary system of much greater speed of action, so that in the matter of a second or less a substantial, though limited, flow of steam can be initiated to the flare, immediately as the flow of gas 24 has reached a selected minimal flow velocity.

The improved system indicated in FIG. 1 provides a differential pressure sensor 56 inside of the flow pipe 22 which is responsive to the flow of gas 24. There are two small diameter pressure lines 59 and 60, one indicating the pressure in an upstream-facing orifice, and the other 60 indicating the pressure in a downstream-facing orifice. These go to a differential pressure switch 62 which will be described in detail in FIGS. 2, 3 and 4. The pressure switch 62 is connected by lead 66 to a source of electrical voltage 66, 68 and by lead 65 to a time delay switch, which will open in a selected short time after the initiation of current flow in the line 65, due to the closing of the pressure switch 62. When the switch 62 closes, current flows in line 65 and through the time delay 64, through lead 67 to a solenoid control 52 which controls the valve 48. The valve 48 is connected into a branch line 46 from the steam supply in line 40 and permits steam to flow through line 50 into the line 44 in parallel with valve 38, which goes to the steam injection means 18 at the top of the stack. The valve 48 and lines 46 and 50 can be of limited capacity such as perhaps 10% of the maximum of the steam flow as desired.

Thus, as soon as a flow in conduit 22, of say 10% of the maximum flare capacity, is initiated the valve 48 will open immediately, and will discharge a selected volume of steam to the stack, sufficient at least for that 10% of the flow, or more. This flow of steam will continue until the main steam valve 38 is opened, after appreciable delay, by the flow of pneumatic fluid 34, to the valve control 36. Once the main steam valve 38 opens, the auxiliary flow through the valve 48 is no longer required, and therefore, at a selected time after the opening of the valve 38, the time delay means 64 acts to open the circuit through leads 54 and 67, to release the solenoid valve and close off the flow of steam through lines 46 and 50. Thereafter so long as the gas 24 flows, the steam valve 38 remains open and the burning of the gas is under smokeless conditions.

When the flow 24 stops the apparatus comprising the time delay 64 resets and is ready for the next initiation of gas flow to the flare.

Figure 2:
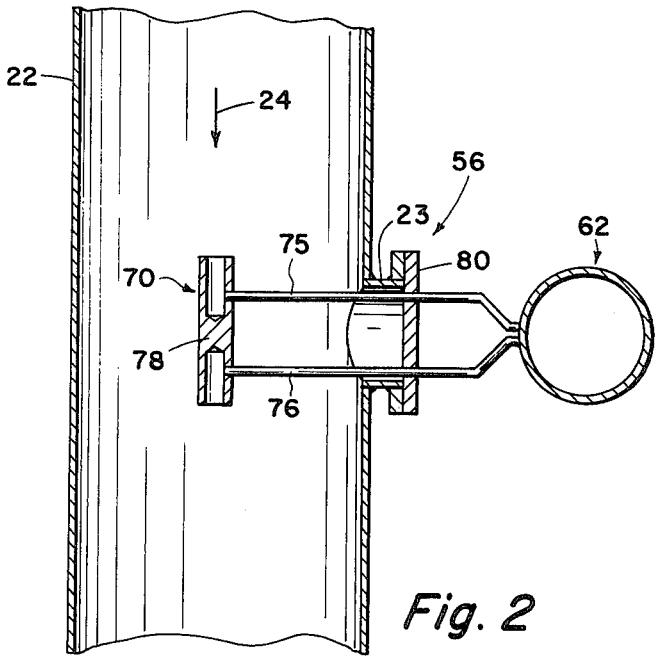
FIGS. 2, 3 and 4 show three views and details of the gas flow-induced differential pressure sensor that provides the pressure signal to initiate steam flow to the flare stack.
Figure 3:
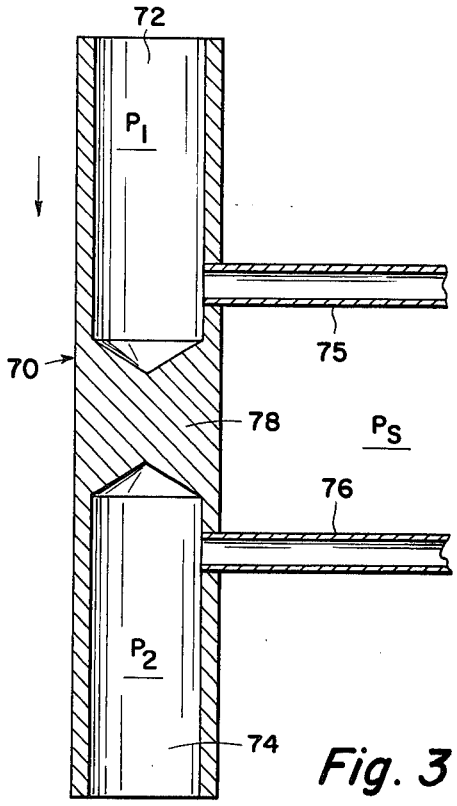
Figure 4:
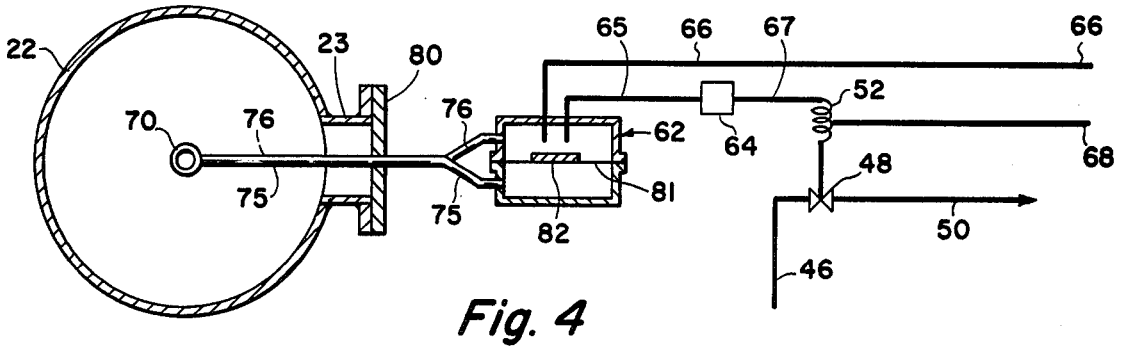

Referring now to FIGS. 2, 3 and 4 there is shown the main gas flow line 22 with the gas flow indicated by arrow 24. In FIG. 3 is shown in cross-section a pressure sensor 70 which comprises a cylindrical metal rod 78 with two openings 72 and 74 bored axially, one from each end, leaving a plug in the middle. There are two small diameter pressure tubes 75 and 76 which are inserted in drilled holes radially, one into each of the cavities 72 and 74. When this apparatus 70 is inserted through a pipe 23 and flange in the side of the flow line or conduit 22, and positioned preferably on the axis of the conduit 22, then the pressure in the cavity 72, which faces upstream, will be a pressure $P_1$ which is equal to $P_A$ which is the ambient pressure in the flowing gas in the vicinity of the device 70, plus an additional pressure P which is proportional to the velocity head, $V^2/2g$. Thus $P_1 = P_A + P_V$.

In the second cavity 74, which is facing downstream, the pressure of $P_2$ will be equal to the ambient pressure $P_A - P_V$. By having a double headed differential pressure sensing device, the difference in pressure between $P_1$ in line 75 and $P_2$ in line 76 will be $P_1 - P_2 = 2V^2/2g$, or twice the velocity head.

The lines 75 and 76 go through the bulkhead 80 covering the flange on pipe 23, to a pressure switch, indicated generally by the numeral 62. This is a cylindrical box having two halves, between which a flexible diaphragm 81 is clamped, and providing thereby, two equal plena, one on each side, one connected to the high pressure line 75 and the other to the low pressure line 76. When there is a gas flow in 22 of a selected fraction, of the design maximum flow, there will be sufficient pressure differential across the diaphragm, and therefore a sufficient deflection of the diaphragm, to close the switch 82, which will close the circuit between the lines 65 and 66, and pass current from a source of voltage between lines 66 and 68, through a time delay circuit-opening device 64, and line 67 to a solenoid valve 52.

The solenoid valve is of limited size, and is very quick-acting, and will open the valve 48 rapidly, allowing a flow of steam from line 46 through the valve 47 and out through lines 50, 44 to the flare stack. The solenoid valve and the pressure switch are conventional, as is also the time delay circuit-opening means 64, which serves to open and cut off the current to the solenoid valve at a selected time after the pressure switch 62 has operated. This time interval is long enough, so that the main stream valve 38 has been open and therefore an adequate supply of smoke suppressant is flowing to the flare.

Figure 5:
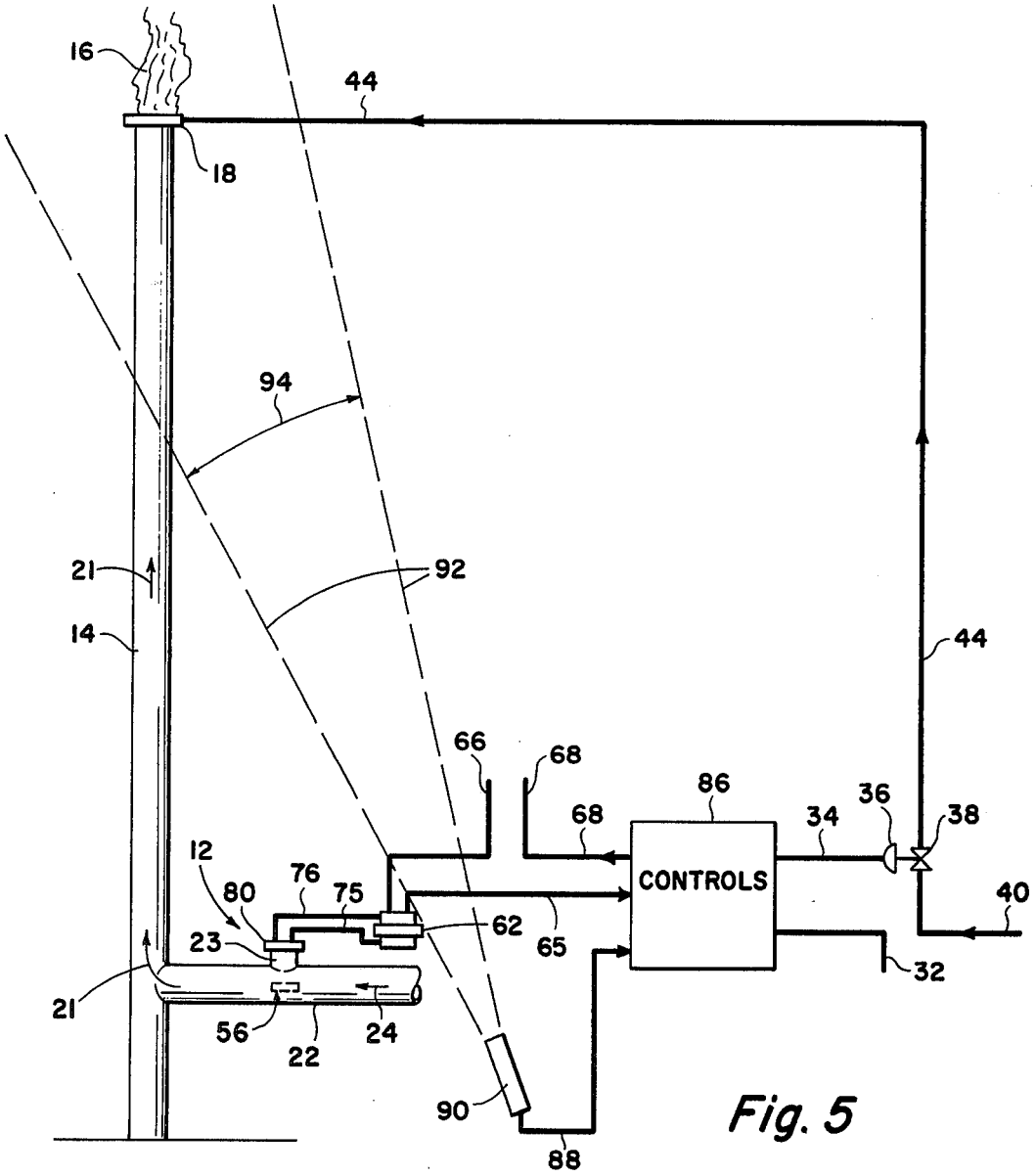
FIG. 5 illustrates a second embodiment of the present invention, in conjunction with the conventional type of photoelectric control for the flow of steam to the flare stack.

Referring now to FIG. 5 there is a second embodiment which utilizes another type of prior art signal-generating means for controlling the flow of steam, when there is gas burning at the top of the flare stack. The signal is generally provided by a photoelectric scanner 90 which has a selected solid angle 94 of window for looking at the flame 16 at the top of the stack 14.

When gas flow is initiated, there will be sudden and rapid as well as smoky burning because no smoke suppressant is being delivered. Thus there will be a flame, which will be seen by sensor 90, and it will transmit a suitable signal voltage by line 88 to a conventional control means for controlling the flow of pressurized pneumatic fluid in line 32 to a pneumatic control line 34, to the valve control means 36, which will open the steam valve 38 and permit steam to flow from line 40 through the valve 38, to the line 44 which supplies the steam injection apparatus 18 at the top of the stack, after smoke production to an offensive degree has occurred.

In FIG. 5, there is also shown the specialized apparatus 12 of this invention such as has been described in connection with FIG. 1. This includes a flow of gas 24 across sensor 56 which creates a differential pressure on lines 75, 76, which control the pressure switch 62 and by lines 65, 68 provide an electrical signal to the pneumatic control means, which provides an appropriate pneumatic signal over line 34 to pneumatically controlled steam valve 38, as does the sensor 90, but measurably before a flame 16, which causes 90 to operate, exists at the area of 16.

This combination of parallel controls from the conventional photoelectric one 90 and the flow sensor 56 of FIGS. 2, 3 and 4, can control the same main steam valve 38. However, because of the inherent delay in operation of the valve once the pneumatic control signal in 34 has been initiated, there still may be too much of a delay in getting steam to the top of the flare. Therefore the system shown in FIG. 1 is preferred, where the rapid control means of this invention, in cooperation with a separate high-speed valve 48, rather than the conventional slow-acting pneumatic valve 38. The control system 12 of this invention can be utilized with any type of prior art device and will serve to provide faster operation of the initiation of steam to the flare stack upon the initiation of a very rapid flow waste gases.

The time delay means 64 has contacts which are normally closed, so that as the switch 62 closes, power is immediately applied to the solenoid valve 52, 48. After the current flows for a selected time, the contacts in the delay means 64 open (which would be after the main valve 28 is open) and permit the valve 48 to close since its flow is no longer required.

The contacts in the time delay means 64 then remain open until the switch 62 opens. That is, when the flow 24 stops, the time delay means 64 then resets, closing its contacts. The system is then ready for the next onset of flow 24.

Many types of time delay switches or relays 64 are available on the market, and no further detail is necessary.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. In a flare system for the smokeless burning in the atmosphere, of suddenly released flows of waste gases, said system including;
   (a) conventional first flow sensing means in the conduit supplying said waste gases to said stack;
   (b) pneumatic fluid control means responsive to said flow sensing means;
   (c) pneumatically controlled first valve means in a steam line for controlling the flow of steam as a smoke suppressant to the flame at the top of the flare stack; said pneumatically controlled first valve means responsive to said pneumatic fluid control means;

the improvement comprising;
   (d) rapid-acting second flow sensing means in said conduit supplying said waste gases;
   (e) first and second pressure lines from said second flow sensing means connected to a fast-acting electrical pressure switch;
   (f) said pressure switch controlling a solenoid operated second valve connected into said steam line in parallel with said first valve to supply steam to said flare stack, and
   (g) time delay means for opening the electrical circuit to said solenoid operated valve after it has been operated for a selected time interval.

2. The system as in claim 1 in which said second flow sensing means is sensitive to a flow of 10% or less of rated flow to said stack.

3. The system as in claim 1 in which said second flow sensing means is sensitive to a flow of at least 1% of rated flow to said stack.

4. The system as in claim 1 in which said second valve has a flow capacity of at least 10% of the flow capacity of said first valve.

5. The system as in claim 1 in which said time delay means operates after an interval which is at least 5 seconds longer than the time to full opening of said first valve.

6. The system as in claim 1 in which said second flow sensing means comprises means in said flow conduit to measure the velocity head due to the flow of gases in said flow conduit.

7. The system as in claim 6 in which said means in said flow conduit comprises;
   (a) axial cylindrical member;
   (b) an upstream-facing first cavity;

(c) a downstream-facing second cavity;

(d) said first and second pressure lines connected respectively to said first and second cavities.

8. In a flare stack system for the smokeless burning in the atmosphere of suddenly released flows of waste gases, said system including;

(a) photoelectric scanning means, for determining when said waste gases are flowing, by the presence of flame at the top of the flare stack;

(b) control means responsive to the output signal of said scanner for controlling the opening of a steam valve;

(c) said steam valve controlling the flow of steam to the flame at the top of said flare stack;

the improvement comprising;

(d) a rapid-acting flow sensor means inserted into the conduit through which said waste gases flow to said flare stack; and (e) means to make said control means responsive to both said photoelectric scanning means and said rapid-acting flow sensor means.

* * * * *